US007789618B2

(12) United States Patent
Burdgick et al.

(10) Patent No.: US 7,789,618 B2
(45) Date of Patent: Sep. 7, 2010

(54) SYSTEMS FOR MOISTURE REMOVAL IN STEAM TURBINE ENGINES

(75) Inventors: Steven S. Burdgick, Guilderland, NY (US); Frolov Boris Ivanovitch, Kharkov (UA)

(73) Assignee: General Electric Company, Schenectady, NY (US)

( * ) Notice: Subject to any disclaimer, the term of this patent is extended or adjusted under 35 U.S.C. 154(b) by 962 days.

(21) Appl. No.: 11/511,598

(22) Filed: Aug. 28, 2006

(65) Prior Publication Data

US 2008/0050221 A1 Feb. 28, 2008

(51) Int. Cl.
*F01D 25/32* (2006.01)

(52) U.S. Cl. ..... 415/169.4

(58) Field of Classification Search ..... 415/169.1, 415/169.2, 169.3, 169.4
See application file for complete search history.

(56) References Cited

U.S. PATENT DOCUMENTS 1,834,451 A * 12/1931 Frey ..... 415/169.4
2,111,878 A * 3/1938 Van Tongeren ..... 415/169.4
3,301,529 A 1/1967 Wood et al.
3,632,225 A * 1/1972 Smith et al. ..... 415/169.4
3,966,355 A * 6/1976 Pierpoline ..... 415/144
4,948,335 A * 8/1990 Silvestri, Jr. ..... 415/169.2
5,573,370 A * 11/1996 Gray et al. ..... 415/169.4
5,984,628 A 11/1999 Gray et al.
7,422,415 B2 * 9/2008 Burdgick et al. ..... 415/1

* cited by examiner

*Primary Examiner*—Edward K. Look
*Assistant Examiner*—Nathaniel Wiehe
(74) *Attorney, Agent, or Firm*—Mark E. Henderson; Ernest G. Cusick; Frank A. Landgraff

(57) ABSTRACT

A system in a steam turbine for removing water droplets from the flowpath of a steam turbine that may include a groove for collecting water droplets, and a plurality of moisture removal holes originating within the groove. The groove may run in a circumferential manner around an outer sidewall of the steam turbine, be axially positioned upstream and in close proximity to the leading edge of a nozzle, and have a gradual slope at a leading edge and a steep wall at a trailing edge. The moisture removal holes may be a channel through the outer sidewall through which the water droplets that collect in the groove may flow.

10 Claims, 3 Drawing Sheets

SYSTEMS FOR MOISTURE REMOVAL IN STEAM TURBINE ENGINES

TECHNICAL FIELD

This present application relates generally to systems for the removal of moisture in steam turbines. More specifically, but not by way of limitation, the present application relates to systems that employ a water removal groove along an outer sidewall of the steam turbine to remove water droplets from the steam flowpath.

BACKGROUND OF THE INVENTION

Water droplets moving through the flowpath of a steam turbine create at least two significant issues. First, the presence of water droplets in the steam turbine flowpath reduces stage efficiency. Second, such moisture causes premature erosion of the turbine blades or buckets, especially those in the last stage of the turbine.

Erosion of turbine blades in the last stages of a steam turbine is a common issue. In general, the erosion is caused by the combination of moisture, the high rotational speeds, and temperature values found in this area of the turbine. Conventional measures to prevent such turbine blade erosion and degradation, while costly, have proven to be largely ineffective. For example, certain measures focus on manufacturing the turbine blade to better withstand the extreme conditions within the steam turbine. The turbine blade, in its most affected areas (which generally include the leading edge of the tip of the turbine blade), is hardened during manufacture or a satellite shield is installed. While such efforts may stave off the erosion of the turbine blades for a short period, the erosion inevitably returns due to the extreme operating conditions within the steam turbine. Additional, such efforts add complexity and costs to the turbine blade.

Others protective measures have focused on the removal of moisture from the steam flowpath so that less water droplet moisture comes into contact with the turbine blades. Conventional systems employing this strategy generally focus on removing water through water drainage arrangements within the casing walls of the steam turbine or through suction slots made in hollow stator blades or nozzles. For example, some known systems attempt moisture removal using suction slots on the pressure or suction side of the nozzles. Other prior art systems focus on removing the moisture at a location that is in very close proximity to the tip of the turbine blade. Nevertheless, moisture in the steam turbine flowpath remains an issue. Thus, there is a need for improved systems for removing water in steam turbine engines.

BRIEF DESCRIPTION OF THE INVENTION

The present application thus may describe a system in a steam turbine for removing water droplets from the flow path of the steam turbine that may include a moisture collector. The moisture collector being located in an outer sidewall of the steam turbine and being axially positioned upstream and in close proximity to the leading edge of a nozzle. The outer sidewall may define an outer flowpath of the steam between a turbine blade and the nozzle. The axial distance between the turbine blade and the nozzle may be at least approximately 0.4 m.

In some embodiments, the moisture collector may include a groove. The groove may be aligned substantially perpendicular to the flow of the water droplets during the operation of the steam turbine. The groove may have a gradual slope at a leading edge and a steep wall at a trailing edge. The radial depth of the groove may be approximately 0.0032 to 0.0094 m. The groove may be a circumferential groove generally disposed around the outer sidewall. In other embodiments, the groove may be a circumferential groove extending intermittently around the outer sidewall. The axial distance between the groove and the leading edge of the nozzle may be approximately 0.025 to 0.127 m. The groove may cut through the entire thickness of the outer sidewall along a majority of path the groove makes around the outer sidewall. The moisture collector may include a plurality of grooves. The axial distance between each of the plurality of grooves may be approximately 0.0127 to 0.0381 m.

The moisture collector further may include a plurality moisture removal holes. Each of the moisture removal holes may be a channel through the outer sidewall through which the water droplets that collect in the groove may be removed. The moisture removal holes may be positioned at a furthest outwardly radial position within the groove. The moisture removal holes may slope in a downstream direction as the moisture removal holes pass through the outer sidewall. An outward suction may be applied to the water removal holes to draw the water droplets through the channel through the outer sidewall.

In some embodiments, the moisture collector may include a plurality of pockets. Each of the pockets may include a substantially circular shaped indentation, and each of the substantially circular shaped indentations may include a gradual slope at a leading edge and a steep wall at a trailing edge. In some of the embodiments, each of the pockets may be a tapering pocket that includes a wide leading edge and a narrow trailing edge.

The present application further describes a system in a steam turbine for removing water droplets from the flowpath of a steam turbine that may include a groove for collecting water droplets, and a plurality of moisture removal holes originating within the groove. The groove may run in a circumferential manner around an outer sidewall of the steam turbine, be axially positioned upstream and in close proximity to the leading edge of a nozzle, and have a gradual slope at a leading edge and a steep wall at a trailing edge. The moisture removal holes may be a channel through the outer sidewall through which the water droplets that collect in the groove may flow.

These and other features of the present application will become apparent upon review of the following detailed description of the preferred embodiments when taken in conjunction with the drawings and the appended claims.

DETAILED DESCRIPTION OF THE INVENTION

Figure 1:
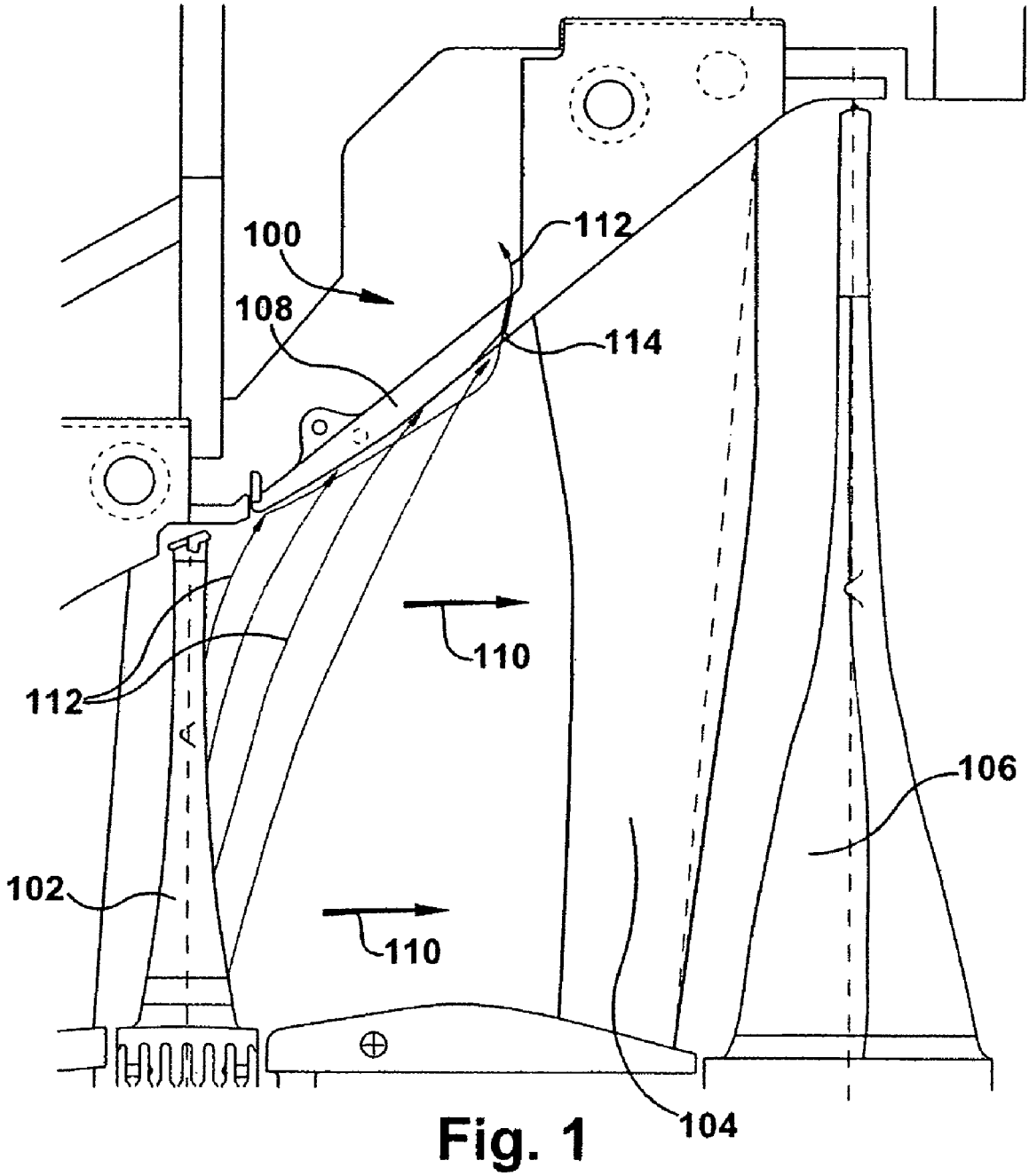
FIG. 1 is a schematic line drawing illustrating a cross-sectional view of an exemplary steam turbine stage in which an embodiment of the present application may operate.

Referring now to the figures, where the various numbers represent like parts throughout the several views, FIG. 1 illustrates a line drawing of a cross-section of a steam turbine stage incorporating a water removal system 100 in accordance with an exemplary embodiment of the present application. FIG. 1 partially shows two stages within a steam turbine, which include a first turbine blade 102 (that is part of a preceding turbine stage) and a nozzle 104 and a second turbine blade 106 (that make up a subsequent, downstream turbine stage). The water removal system 100 may be used between any of the stages in a steam turbine, though primarily it may be employed in the later stages. For example, in some embodiments, the first turbine blade 102 may be a turbine blade in the next-to-last stage, and the second turbine blade 106 may be a turbine blade in the last stage of the steam turbine.

In general, conventional turbine design is such that a relatively large axial distance is maintained between the first turbine blade 102 and the nozzle 104. In general, this distance may be approximately 0.4 m. (Note that this measurement generally varies with the length of the last stage turbine blade. The 0.4 m measurement assumes a last stage turbine blade length of approximately 1.2 m.) An outer sidewall 108 may span this distance to enclose the steampath of the turbine. As illustrated in FIG. 1, arrows depict the flowpath of the steam through the turbine stage as well as the flow of water droplets that may be present. A steam arrow 110, which is pointed in the downstream direction, illustrates the approximate flowpath of the steam. A plurality of water droplet arrows 112 illustrates the natural flow of water droplets that may be present in the flowpath.

Water droplets, as depicted by the water droplet arrows 112, may flow from the first turbine blade 102 to the outer sidewall 108. This may be caused by the rotation of the first turbine blade 102 and the other forces acting within the flowpath. That is, at least in part, the extreme rotational speed of the first turbine blade 102 may essentially "fling" or push the water droplets toward the outer sidewall 108, where they may collect. As further illustrated by the water droplet arrows 112, once on the outer sidewall 108, the water droplets may move along the outer sidewall 108 toward the nozzle 104. This movement may be caused by both the accumulation of water droplets and pushing action of the steam flow in the downstream direction. Thus, in operation, the relatively large distance maintained between the first turbine blade 102 and the nozzle 104 and the natural flow of water droplets in the steam flowpath may provide for an accumulation of water droplets along the outer sidewall 108 and movement of the accumulation toward the nozzle 104.

Figure 2:
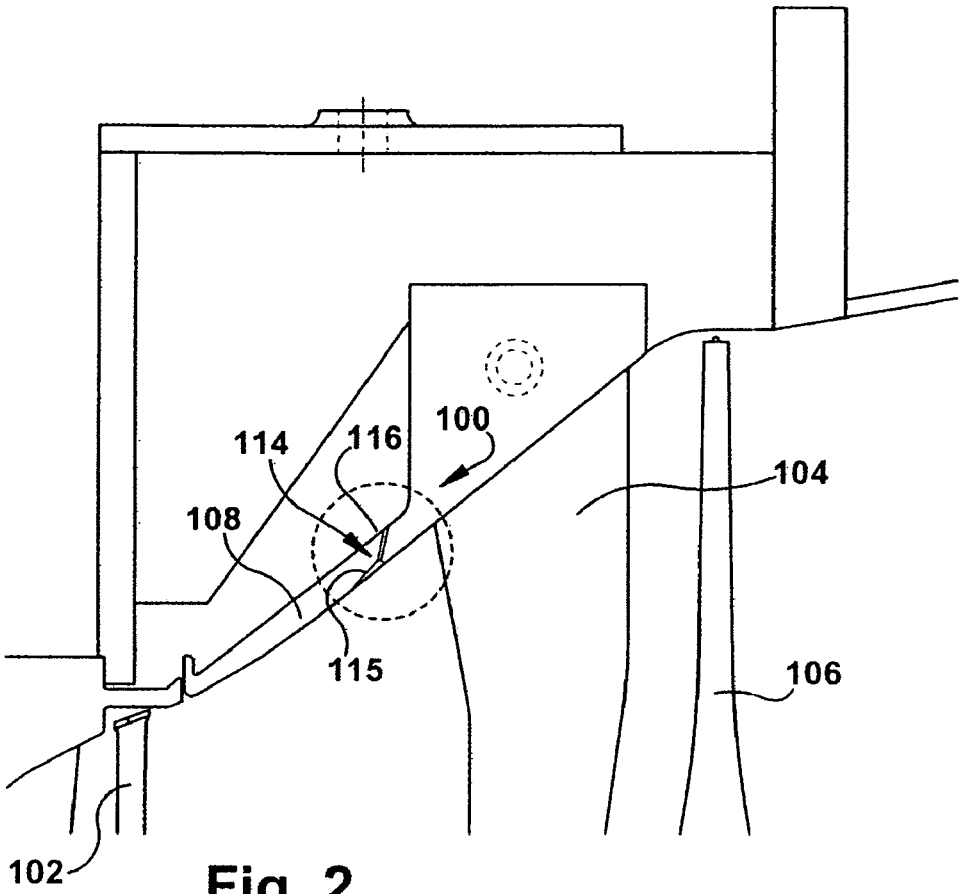
FIG. 2 is a schematic line drawing illustrating a cross-sectional view of a moisture collector according to an exemplary embodiment of the present application.

As described, if the accumulated moisture were allowed to reach the nozzle 104 and subsequent turbine blades, it may cause turbine blade erosion and potentially decrease turbine efficiency. Accordingly, as shown in more detail in FIG. 2, a moisture collector 114 may be positioned along the outer sidewall 108 in proximity to the leading edge of the nozzle 104. Using the moisture collector 114, as described hereinafter, the accumulated water may be removed before it reaches the nozzle 104, the turbine blade 106, or the nozzle or turbine blades of any of the subsequent stages.

Figure 3:
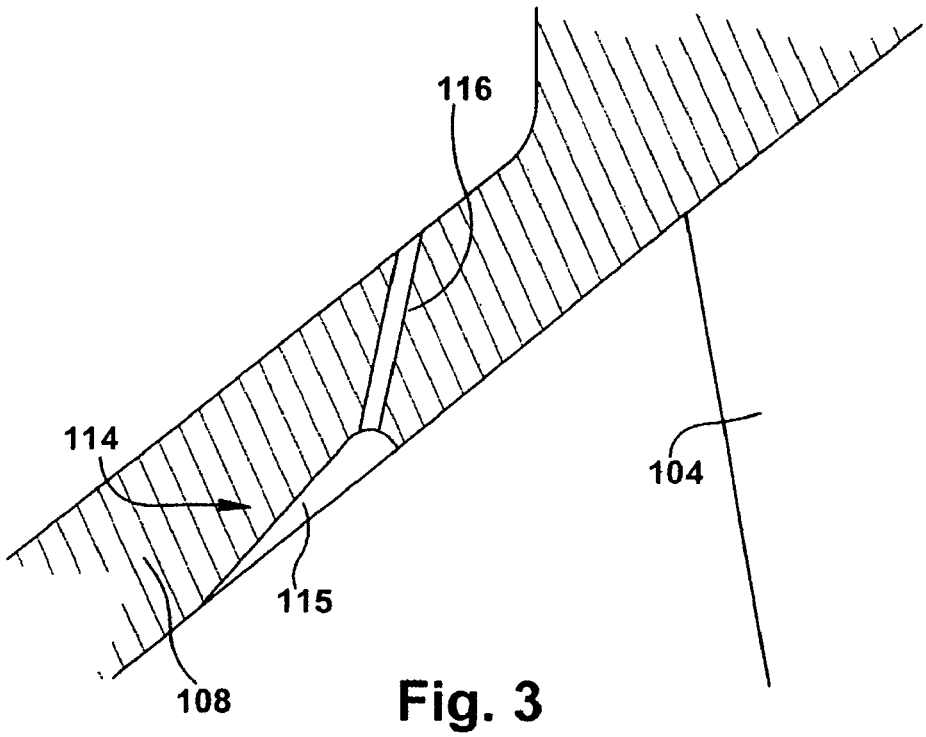
FIG. 3 is a schematic line drawing illustrating a cross-sectional view of a moisture collector according to an exemplary embodiment of the present application.

The moisture collector 114 includes several embodiments. In some of these, the moisture collector 114 may include a groove or slot or several grooves or slots, hereinafter a moisture removal groove 115. The moisture removal groove 115 may be an indentation in the outer sidewall 108 that runs substantially perpendicular to the flow of steam through the turbine and the flow of the accumulated water along the outer sidewall 108. The radial depth of the moisture removal groove 115 may be approximately 0.0032 to 0.0094 m. As illustrated in FIG. 3, the moisture removal groove 115 may include a gradual slope at its leading edge and a steep wall at its trailing edge. A gradual slope may be defined as a slope that creates an angle with the plane of the outer sidewall 108 of between about 5° to 10°. The steep wall may be defined as a slope that creates an angle with the plane of the outer sidewall 108 of between about 80° and 100°.

The moisture removal groove 115 may run in a circumferential manner around the outer sidewall 108. In some embodiments, the moisture removal groove 115 may run intermittently in a circumferential manner around the outer sidewall 108. The intermittent placement of the moisture removal groove 115 may correspond to the circumferential locations of each of the nozzles 104. The axial distance between the moisture removal groove 115 and the leading edge of the nozzle 104 may be a relatively small one. For example, the axial distance between the moisture removal groove 115 and the leading edge of the nozzle 104 may be approximately 0.025 to 0.127 m. The moisture collector 114 may include a single moisture removal groove 115 or a plurality that are substantially parallel to each other. In the case of the plurality of moisture removal grooves 115, the grooves 115 may be spaced approximately 0.0127 to 0.0381 m apart. Those of ordinary skill in the art will appreciate that these specific configurations and measurements may vary significantly depending on the application in which the disclosed invention is used.

Figure 4:
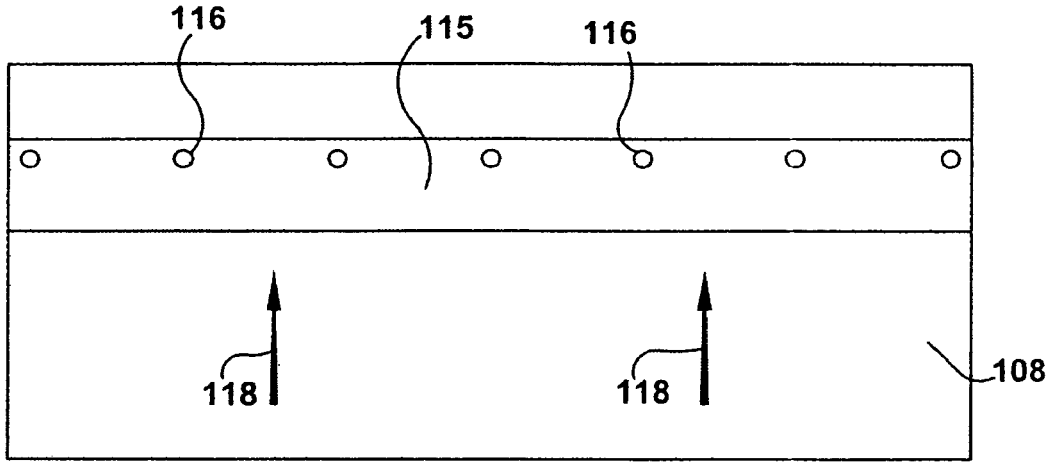
FIG. 4 is a schematic line drawing illustrating an outward radial view of a section of an outer sidewall of the steam turbine with a moisture collector according to an exemplary embodiment of the present application.

The moisture collector 114 further may include moisture removal holes 116, which, as shown in greater detail in FIG. 3, may provide a channel or aperture through the outer sidewall 108 to carry away the water that accumulates in the moisture removal groove 115. The moisture removal holes 116 may be positioned at the furthest outwardly radial position within the moisture removal groove 115. As such, given the gradual upstream slope and the steep downstream wall of some embodiments, the moisture removal holes 116 may be positioned toward the downstream edge of the moisture removal groove 115, as shown. From this beginning location, as illustrated, the moisture removal holes 116 may angle downstream, i.e., slope in a downstream direction as depicted in the FIG. 3, as the aperture the form passes through the outer sidewall 108. As illustrated in FIG. 4, in some alternative embodiments, the moisture removal holes 116 may be positioned at regular intervals around the circumferential path of the moisture removal groove 115. For example, the distance between neighboring moisture removal holes 116 may be approximately 0.0051 to 0.0381 m. As stated and as shown in FIG. 4, the moisture removal groove 115 may run approximately perpendicular to the flow of steam through the turbine, the direction of which is depicted by arrows 118.

In alternative embodiments, the moisture removal groove 115 may cut through the entire thickness of the outer sidewall 108. In such embodiments, a connecting structure (not shown) may intermittently interrupt the moisture removal groove 115 to connect the outer sidewall 108 that is upstream of the moisture removal groove 115 the outer sidewall 108 that is downstream of the moisture removal groove 115.

Figure 5:
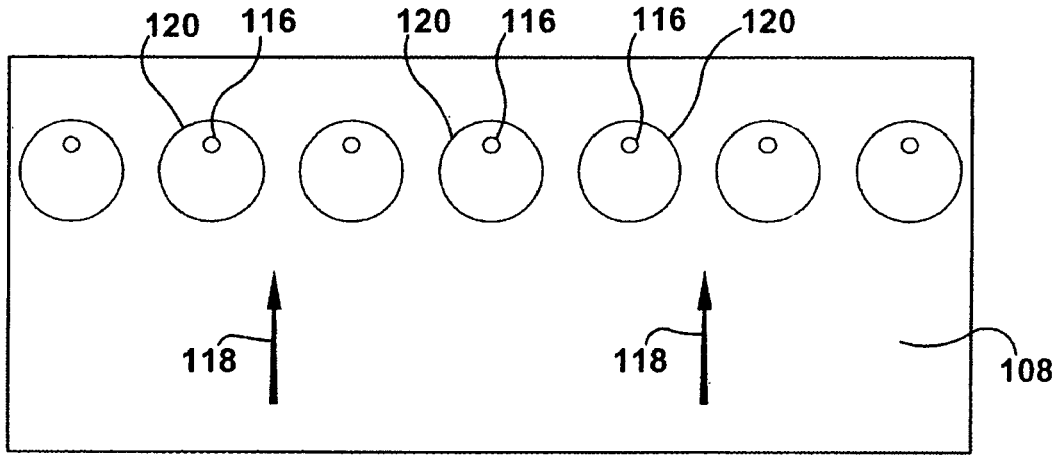
FIG. 5 is a schematic line drawing illustrating an outward radial view of a section of an outer sidewall of the steam turbine with a moisture collector according to an alternative embodiment of the present application.

Additionally, in some alternative embodiments, as illustrated in FIG. 5, the moisture collector 114 may include a plurality of moisture collection pockets 120, which may be used instead of or in addition to the moisture removal grooves 115. The moisture collection pockets may form a substantially circular shaped indentation in the surface of the outer sidewall 108. The sides of the moisture collection pocket may curve downward toward a deep spot within the pocket (i.e., a spot that is the furthest radial distance from the rotor). The deep spot also may be located toward the trailing edge of the moisture collection pocket 120, such that the cross-section of the moisture collection pocket 120 is similar to the cross-section of moisture removal groove 115 shown in FIG. 3 (i.e., the moisture collection pocket 120 may include a gradual slope at its leading edge and a steep wall at its trailing edge). In such an embodiment, the moisture removal hole 116 may be located at the deep spot. The approximate diameter of each of the moisture collection pockets 120 may be approximately 0.0089 to 0.0305 m.

Figure 6:
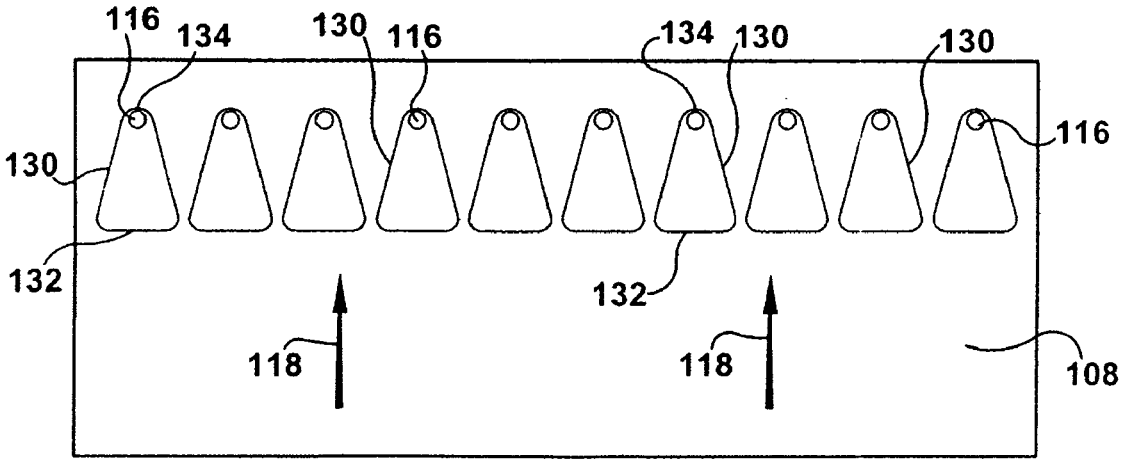
FIG. 6 is a schematic line drawing illustrating an outward radial view of a section of an outer sidewall of the steam turbine with a moisture collector according to another alternative embodiment of the present application.

FIG. 6 illustrates an alternative embodiment of the moisture collection pocket, a tapering moisture collection pocket 130. The tapering moisture collection pocket 130 may form an indentation in the surface of the outer sidewall 108 that has a wide leading edge 132 and a narrow trailing edge 134. The sides of the tapering moisture collection pocket 130 may curve downward toward a deep spot within the pocket (i.e., a spot that is the furthest radial distance from the rotor). The deep spot may be located toward the narrow trailing edge 134 of the tapering moisture collection pocket 130, such that the cross-section of the tapering moisture collection pocket 130 is similar to the cross-section of moisture removal groove 115 shown in FIG. 3 (i.e., the tapering moisture collection pocket 130 may include a gradual slope at its wide leading edge 132 and a steep wall at its narrow trailing edge 134). In such an embodiment, the moisture removal hole 116 may be located at the deep spot.

As further illustrated in FIGS. 5 and 6, the moisture collection pockets 120, 130 may be located at regular intervals in a circumferential manner around the outer sidewall 108. The circumferential distance between neighboring moisture collection pockets 120, 130 may be approximately 0.0051 to 0.0381 m. The axial distance between the pockets and the leading edge of the nozzle 104 may be as discussed for the moisture removal groove 115 and multiple rows of moisture collection pockets may be used as well. Those of ordinary skill in the art will appreciate that these specific configurations and measurements may vary depending on the application in which the disclosed invention is used.

In operation, water droplets may form in the stages, especially the later stages, of a steam turbine. The water droplets may come into contact with the rotating turbine blades, such as the first turbine blade 102. The rotational speed of the turbine blade and other forces within the steam turbine may push or cause the water droplets to flow toward the outer sidewall 108. The water may accumulate on the outer sidewall 108 and, because of the continued accumulation and the direction of the steam flow, be pushed along the outer sidewall 108 toward the downstream nozzle of the next stage, i.e., the nozzle 104.

As it moves along the outer sidewall 108, the accumulated water may encounter a water collector 114, which may be position in close proximity to the leading edge of the nozzle 104 of the subsequent turbine stage. The water may flow into the water collector 114 (which, by way of example and as discussed, may be a moisture removal groove 115 that cuts through the outer sidewall 108, a moisture removal groove 115 coupled to a water removal hole 116, or a moisture collection pocket 120, 130 coupled to a water removal hole 116) and through the outer sidewall 108. Certain forces acting within the steam flowpath may aid this flow. For example, the reduction in axial steam pressure along this area of the outer sidewall may force the accumulated moisture into and through the water collector 114, and thus remove the moisture from the steam flowpath. In some embodiments, an outward suction may be applied per conventional methods to the water removal holes 116 to draw the water through the channels and aid in the water removal process. This may be achieved, for example, by constructing a circumferential chamber over the water removal holes 116 and connecting this circumferential chamber to the condenser. Because the condenser is at a much lower pressure, a vacuum would be created through the water removal holes 116. The moisture, once extracted through the outer sidewall 108 may flow around the outside of the outer sidewall 108 to the bottom of the turbine stage, where it may collect into a drain so that the moisture may be removed from the turbine by conventional methods.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A system in a steam turbine for removing water droplets from the flow path of the steam turbine, the system comprising a moisture collector, said moisture collector being located in an outer sidewall of the steam turbine and being axially positioned upstream and in close proximity to the leading edge of a nozzle;

wherein:

the moisture collector comprises a plurality of recessed pockets; and each of the recessed pockets comprises a tapering recessed pocket that includes a wide leading edge and a narrow trailing edge.

2. The system of claim 1, wherein each of the tapering recesses pockets comprises a gradual slope at a leading edge and a steep wall at a trailing edge.

3. The system of claim 1, wherein each of the tapering recessed pockets includes a moisture removal hole, each of the moisture removal holes comprising a channel through the outer sidewall through which the water droplets that collect in the tapering recessed pocket may exit the flowpath of the steam turbine during operation; and wherein each of the moisture removal hole is positioned at a furthest outwardly radial position within the tapering recessed pocket.

4. The system of claim 3, wherein the moisture removal holes slope in a downstream direction as the moisture removal holes pass through the outer sidewall.

5. The system of claim 3, wherein an outward suction is applied to the water removal holes to draw the water droplets through the channel through the outer sidewall.

6. The system of claim 1, wherein the outer sidewall defines an outer flowpath of the steam between a turbine blade and the nozzle.

7. The system of claim 6, wherein the axial distance between the turbine blade and the nozzle is at least approximately 0.4 m.

8. The system of claim 1, wherein the radial depth of the tapering recessed pockets groove is between approximately 0.0032 to 0.0094 m.

9. The system of claim 1, wherein the tapering recessed pockets are aligned in a row that circumferentially extends around the outer sidewall of the steam turbine.

10. The system of claim 1, wherein the axial distance between the narrow trailing edge of the tapering recessed pockets and the leading edge of the nozzle is between approximately 0.025 to 0.127 m.

* * * * *